US007273211B2

(12) United States Patent
Yanagida

(10) Patent No.: US 7,273,211 B2
(45) Date of Patent: Sep. 25, 2007

(54) PAPER-SHEET HANDLING APPARATUS

(75) Inventor: Hiroshi Yanagida, Tokyo (JP)

(73) Assignees: Fujitsu Limited, Kawasaki (JP); Fujitsu Frontech Limited, Tokyo (JP)

( * ) Notice: Subject to any disclaimer, the term of this patent is extended or adjusted under 35 U.S.C. 154(b) by 244 days.

(21) Appl. No.: 10/992,652

(22) Filed: Nov. 22, 2004

(65) Prior Publication Data

US 2006/0017211 A1 Jan. 26, 2006

(30) Foreign Application Priority Data

Jul. 20, 2004 (JP) ..... 2004-212207

(51) Int. Cl.
*B65H 5/22* (2006.01)

(52) U.S. Cl. ..... 271/3.14; 271/9.02; 271/9.11; 271/116; 271/163; 221/197; 221/151

(58) Field of Classification Search ..... 271/3.14, 271/9.1, 9.02, 9.04, 9.11, 116, 162, 163; 221/197, 221/198, 287, 151; 109/45, 56, 66, 53, 55
See application file for complete search history.

(56) References Cited

U.S. PATENT DOCUMENTS

| | | | | |
|---|---|---|---|---|
| 3,791,392 | A | 2/1974 | Hanson | |
| 3,841,550 | A | 10/1974 | Kaneda et al. | |
| 4,251,010 | A | 2/1981 | Schmeykal et al. | |
| 4,253,651 | A | 3/1981 | McInerny et al. | |
| 4,325,277 | A * | 4/1982 | Uchida et al. | 83/205 |
| 4,772,005 | A * | 9/1988 | Hosking et al. | 271/9.05 |
| 5,161,736 | A | 11/1992 | Roccoberton et al. | |
| 5,342,165 | A | 8/1994 | Graef et al. | |
| 5,564,691 | A | 10/1996 | Hatamachi et al. | |
| 5,743,429 | A | 4/1998 | Morofsky | |
| 6,003,856 | A | 12/1999 | Holland-Letz et al. | |
| 6,435,329 | B1 | 8/2002 | Amari et al. | |
| 2003/0000957 | A1 | 1/2003 | Brexel et al. | |
| 2003/0193273 | A1 | 10/2003 | Yamashita et al. | |
| 2004/0056411 | A1 | 3/2004 | Duesterhus et al. | |

FOREIGN PATENT DOCUMENTS

| | | |
|---|---|---|
| DE | 28 00 707 | 8/1979 |
| GB | 2 182 315 A | 5/1987 |
| JP | 63-241691 | 10/1988 |
| JP | 2003-30716 | 1/2003 |
| WO | WO 01/25126 A | 4/2001 |

OTHER PUBLICATIONS

Patent Abstracts of Japan, vol. 2003, No. 05, May 12, 2003 & JP 2003 030716 A, Jan. 31, 2003 *abstract*.

* cited by examiner

*Primary Examiner*—David H. Bollinger
*Assistant Examiner*—Kaitlin S Joerger
(74) *Attorney, Agent, or Firm*—Kratz, Quintos & Hanson, LLP.

(57) ABSTRACT

A paper-sheet handling apparatus includes a cassette that stores a paper sheet; a cassette compartment that stores a plurality of the cassettes; a feeding mechanism that feeds out the paper sheet stored in the cassette; a conveying mechanism that conveys the paper sheet fed out; a sheet discharging port through which the paper sheet is discharged out; a sheet discharging mechanism that discharges the paper sheet through the sheet discharging port; and a feeding control mechanism that controls feeding out of the paper sheet stored in the cassette. The feeding control mechanism has a function of selectively feeding out the paper sheet from the cassette, and the function is realized by a single drive source.

14 Claims, 10 Drawing Sheets

PAPER-SHEET HANDLING APPARATUS

BACKGROUND OF THE INVENTION

1) Field of the Invention

The present invention relates to a paper-sheet handling apparatus that performs charging or discharging a paper sheet, and more particularly, to a paper-sheet handling apparatus capable of selectively discharging a bill of different denominations efficiently.

2) Description of the Related Art

Conventionally, a paper-sheet handling apparatus that performs discharging paper sheets, such as a bill, a check, a ticket, or a cash voucher, is used. The paper-sheet handling apparatus is used, for example, as a cash processor, such as a bill charging/discharging machine, or an apparatus mounted on an automated machine, such as cash dispenser (CD) or an automatic teller machine (ATM).

As shown in FIG. 1, a paper-sheet handling apparatus 100 includes a bill discharging unit 200, a bill conveying unit 210, a rejecting unit 220, a feeding/conveying unit 230, and a cassette storage unit 240. The cassette storage unit 240 includes a plurality of cassettes 300. Each of the cassettes 300 stores a pile of bills of different denominations. The bill stored in the cassettes 300 is fed out from the cassettes 300 by a bill feeding/conveying apparatus A that performs feeding of the bill. Then, the bill is discharged through the feeding/conveying unit 230, the bill conveying unit 210, and the bill discharging unit 200.

FIG. 14A is a schematic diagram of a conventional bill feeding/conveying apparatus A, and FIG. 14B is a schematic diagram of a drive system of the conventional bill feeding/conveying apparatus A. The cassettes 300 will be explained as the cassettes 300 that form a two-stage structure by arranging one of the cassettes 300 in an upper portion in the paper-sheet handling apparatus and the other one of the cassettes 300 in a lower portion in the paper-sheet handling apparatus. Each of the cassettes 300 includes a different denomination of bills.

As shown in FIGS. 14 and 14B, the bill feeding/conveying apparatus A includes feeding/conveying drive motors 430 and 440 that are provided at an upper position and a lower position in the cassette storage unit 240 shown in FIG. 1, drive transmitting gears 515 that transmit driving of the feeding/conveying drive motors 430 and 440, and pickup rollers 600 and 610 that convey a bill. A separation mechanism that separates bills is provided near the pickup rollers 600 and 610.

Drive gears 510 that are fixed on tips (right ends in FIG. 14B) of output shafts of the feeding/conveying drive motors 430 and 440 and the drive transmitting gears 515 that are fixed on tips (right ends in FIG. 14B) of drive shafts of the pickup rollers 600 and 610 are coupled to each other by a pulley belt 516. A rotation drive force of the feeding/conveying drive motors 430 and 440 is transmitted through the drive gears 510 and the drive transmitting gears 515 to rotate the pickup rollers 600 and 610. The bill is fed out by the rotation.

In other words, in the conventional bill feeding/conveying apparatus A, when a bill stored in the cassette 300 that is arranged at the upper portion is fed out and conveyed, the feeding/conveying drive motor 430 is driven in a forward rotation, which is in a counterclockwise direction shown with an arrow in a solid line in FIG. 14A, to rotate the pickup roller 600 in a direction to which the bill is conveyed, which is the counterclockwise direction.

On the other hand, when a bill in the cassette 300 that is arranged at the lower portion is fed out and conveyed, the feeding/conveying drive motor 440 is similarly driven in a forward rotation, which is in a counterclockwise direction shown with an arrow in a solid line in FIG. 14A, to rotate the pickup roller 610 in a direction to which the bill is conveyed, which is a counterclockwise direction.

In the bill feeding/conveying apparatus A, if a collateral rotation of the pickup rollers 600 and 610 or failure, in separation of bills occurs, a tip of a bill sticks out from a bill feeding port 325 (FIG. 3B) that is formed at a tip of the cassette 300. In this case, it is necessary to re-set the bill that sticks out inside the cassette 300.

Therefore, conventionally, the bill that slightly sticks out from the bill feeding port 325 is returned inside the cassette 300 by a bill returning control. The bill returning control is performed by driving the feeding/conveying drive motor 430 or 440 in a reverse rotation to reversely rotate the pickup roller 600.

Such a technology is disclosed in, for example, Japanese Patent Application Laid-Open No. 2003-030716 Publication.

However, in the bill feeding/conveying apparatus A in the conventional paper-sheet handling apparatus, more than one drive sources (feeding/conveying drive motors 430 and 440) are required. As described above, one each of the feeding/conveying drive motor 430 or 440 is provided for each denomination of bills. By each the feeding/conveying drive motor 430 or 440, a bill of different denominations separately stored in each of the cassettes 300 are fed out. Consequently, a number of parts that forms the drive system increases, thereby increasing manufacturing cost and making a rotation control (forward rotation/reverse rotation) of the conveying drive motors 430 and 440 complicated. Furthermore, in recent years, since a space for an apparatus to be placed is limited, a paper-sheet handling apparatus that is compact and that can be placed in a small space is desired.

SUMMARY OF THE INVENTION

It is an object of the present invention to solve at least the above problems in the conventional technology.

A paper-sheet handling apparatus according to one aspect of the present invention includes a cassette that stores a paper sheet; a cassette compartment that stores a plurality of the cassettes; a feeding mechanism that feeds out the paper sheet stored in the cassette; a conveying mechanism that conveys the paper sheet fed out; a sheet discharging port through which the paper sheet is discharged out; a sheet discharging mechanism that discharges the paper sheet through the sheet discharging port; and a feeding control mechanism that controls feeding out of the paper sheet stored in the cassette, wherein the feeding control mechanism has a function of selectively feeding out the paper sheet from the cassette, and the function is realized by a single drive source.

A paper-sheet handling apparatus according to another aspect of the present invention includes a cassette that stores a paper sheet; a cassette compartment that stores a plurality of the cassettes; a feeding mechanism that feeds out the paper sheet; a conveying mechanism that conveys the paper sheet fed out; a sheet discharging port through which the paper sheet is discharged out; a sheet discharging mechanism that discharges the paper sheet through the sheet discharging port; a feeding control mechanism that controls feeding out of the paper sheet; a feeding driving unit that outputs a drive force by which the paper sheet is conveyed in a direction of feeding the paper sheet; a first gear unit that makes the feeding control mechanism rotate by transmitting a drive force of the feeding driving unit; and a second gear unit that makes the feeding control mechanism rotate by transmitting the drive force of the feeding driving unit, wherein the first gear unit and the second gear unit include a rotation controlling unit that controls rotation of the feeding mechanism based on a direction of the rotation of the feeding driving unit, and the directions of the feeding driving unit that allow the rotation controlling units in the first gear unit and the second gear unit to make the feeding mechanism is different from each other.

The other objects, features, and advantages of the present invention are specifically set forth in or will become apparent from the following detailed description of the invention when read in conjunction with the accompanying drawings.

DETAILED DESCRIPTION

Exemplary embodiments of a paper-sheet handling apparatus according to the present invention will be explained below in detail with reference to the accompanying drawings. The present invention is not limited to the embodiments described below.

Figure 1:
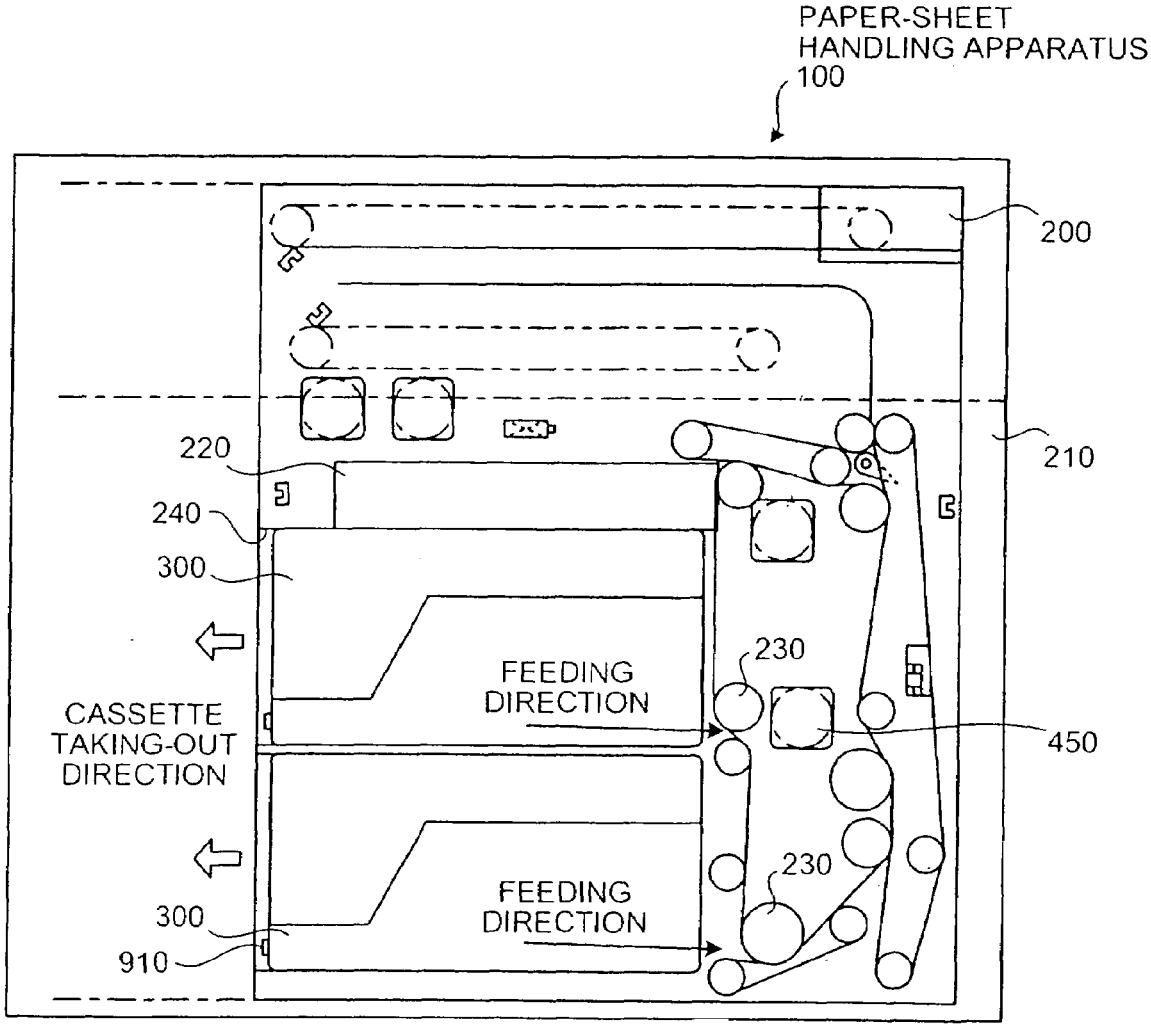
FIG. 1 is a schematic diagram of a paper-sheet handling apparatus according to an embodiment of the present invention.
Figure 2:
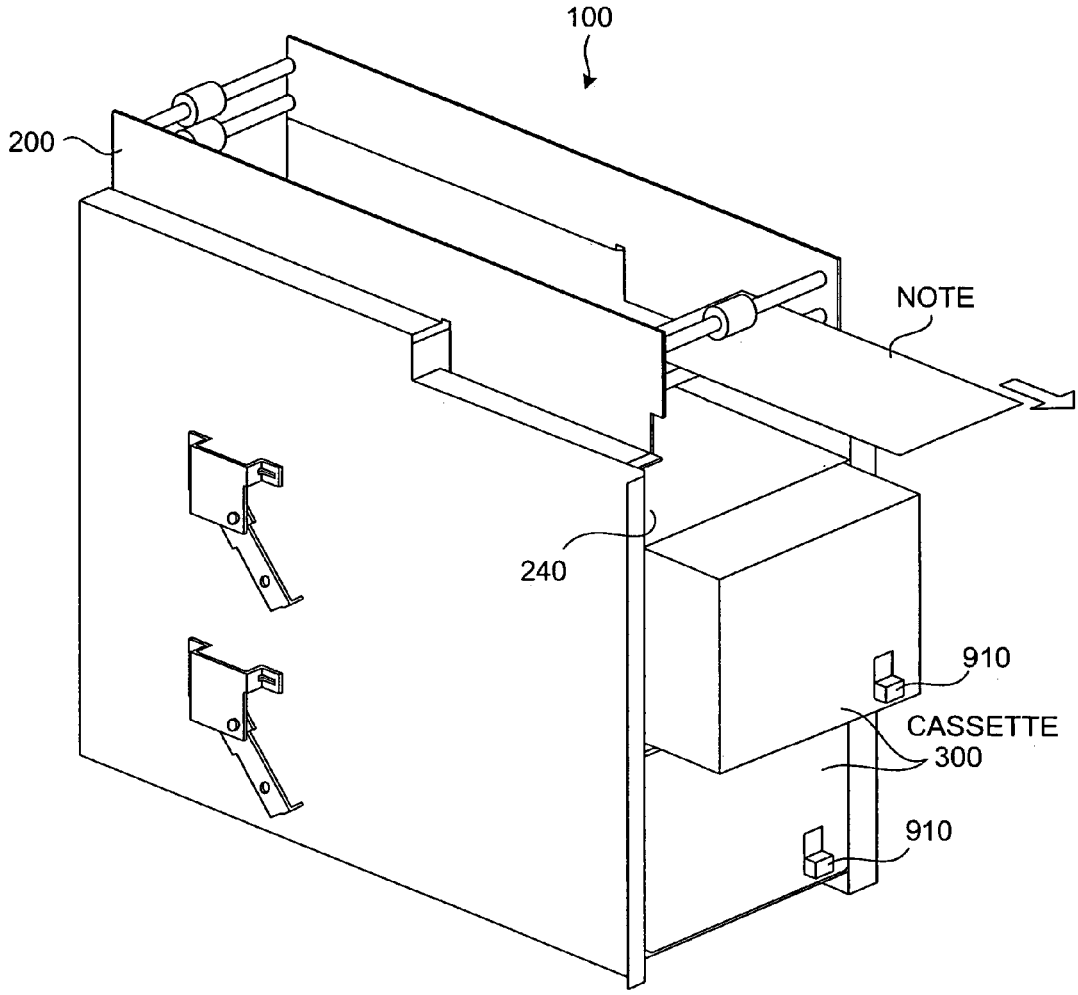
FIG. 2 is a perspective view of the paper-sheet handling apparatus.
Figure 3A:
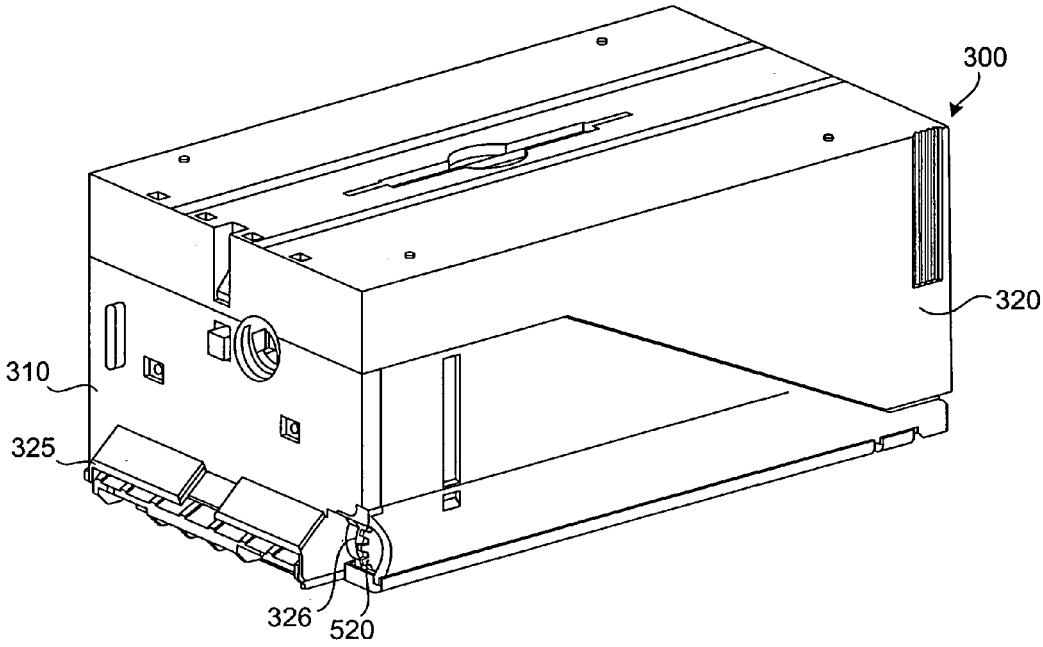
FIG. 3A is a perspective view of a cassette of the paper-sheet handling apparatus.
Figure 3B:
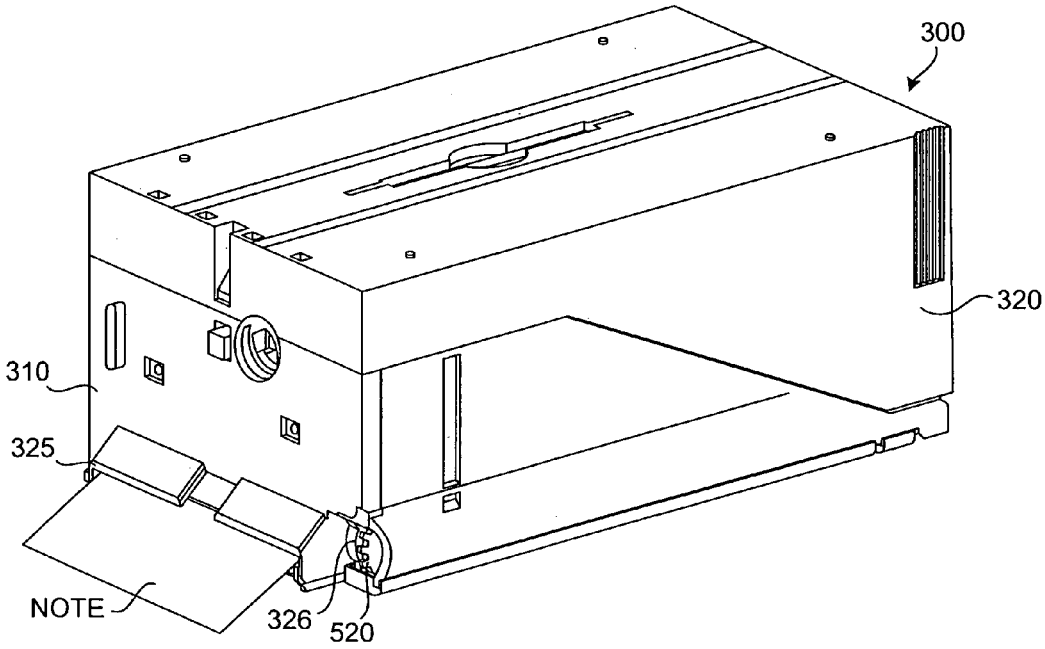
FIG. 3B is a perspective view of the cassette when a bill is fed out.

FIG. 1 is a schematic diagram of a paper-sheet handling apparatus 100 according to an embodiment of the present invention. FIG. 2 is a perspective view of the paper-sheet handling apparatus 100. FIG. 3A is a perspective view of a cassette 300 provided in the paper-sheet handling apparatus 100. FIG. 3B is a perspective view of the cassette 300 a bill is fed out.

As shown in FIG. 1, the paper-sheet handling apparatus 100 includes a cash discharging unit 200, a bill conveying unit 210, a rejecting unit 220, a feeding/conveying unit 230, and a cassette storage unit 240.

The cassette storage unit 240 stores more than one of the cassettes 300. One of the cassettes 300 is arranged above the other one of the cassettes 300 in the cassette storage unit 240. Each of the cassettes 300 stores a bill of a different denomination. The paper-sheet handling apparatus can feed out bills of different denominations (two denominations) from the cassettes 300.

A case in which the cassettes 300 for two denominations are stored in the cassette storage unit 240, which is a standard type, is shown as an example. It is possible to increase a number of cassettes 300 to a maximum of six by expansion so that six denominations of bills can be handled. Furthermore, since the paper-sheet handling apparatus 100 according to the embodiment of the present invention is a relatively compact, a maximum number of bills that can be stored in the cassette 300 is 500 while a regular paper-sheet handling apparatus stores about 2000 bills in a cassette.

Figure 6:
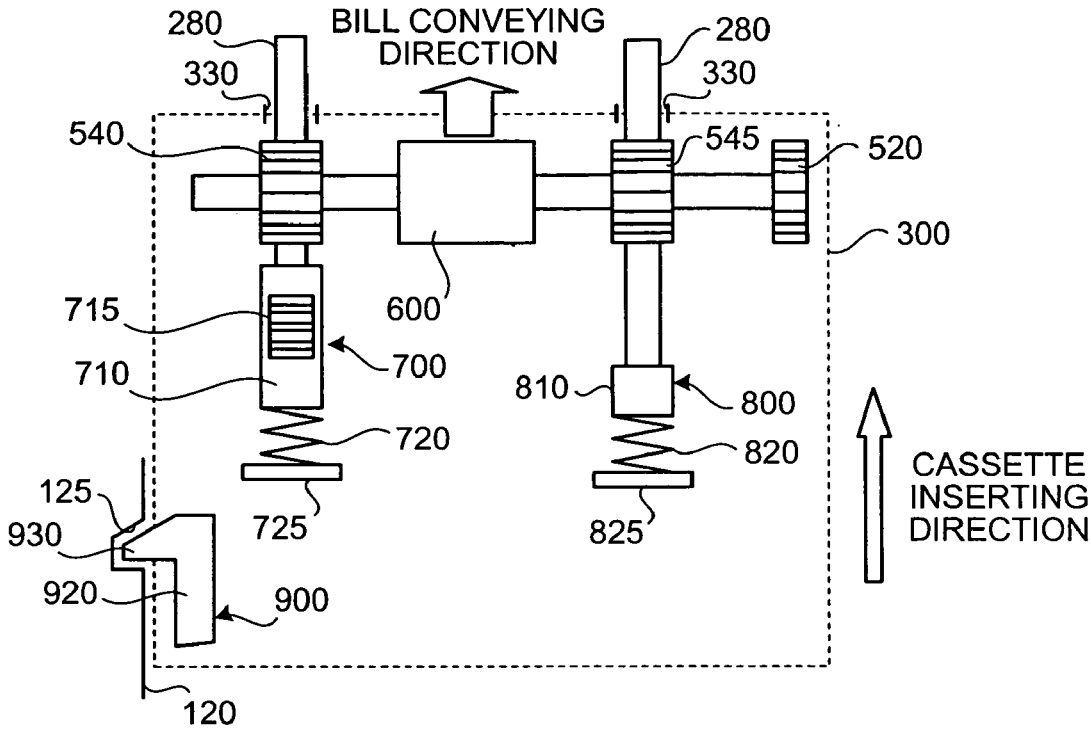
FIG. 6 is a schematic diagram of a feeding control mechanism of the paper-sheet handling apparatus.

When the cassette 300 is set in the cassette storage unit 240, a cassette attaching/detaching mechanism 900 shown in FIG. 6 automatically operates to fix the cassette 300 at a predetermined position. The cassette attaching/detaching mechanism 900 includes a cassette attaching/detaching button 910. When the cassette attaching/detaching button 910 is pressed, the cassette attaching/detaching mechanism 900 is released by an elastic force of pressure springs 720 and 820 shown in FIG. 6, and the cassette 300 is ejected in a direction to which the cassette 300 is taken out.

When the cassette 300 is set in the cassette storage unit 240, a drive gear 510 of a feeding/conveying drive motor 450 shown in FIG. 6 and a drive transmitting gear 520 that rotates a pickup roller 600 that is provided in the cassette 300 are engaged. Therefore, rotation driving of the drive gear 510 that is generated by the feeding/conveying drive motor 450 is transmitted to the drive transmitting gear 520, thereby rotating the pickup roller 600 to feed out a bill.

The cash discharging unit 200 has a function of discharging a bill, which is conveyed by the bill conveying unit 210, one by one (spray type).

The bill conveying unit 210 has a function of conveying a bill that is fed out from the cassette 300 and that is conveyed from the feeding/conveying unit 230 to the cash discharging unit 200. The bill is discharged from the cash discharging unit 200.

The rejecting unit 220 includes a length/thickness detecting sensor that detects an abnormal sheet. The abnormal sheet to be detected is the sheet that has a different thickness or length from other sheets. Such abnormal sheet is stored in the rejecting unit 220 without being discharged from the bill discharging unit 200.

The feeding/conveying unit 230 has a function of conveying the bill fed out from the cassette 300 to the bill conveying unit 210 one by one.

Figure 4A:
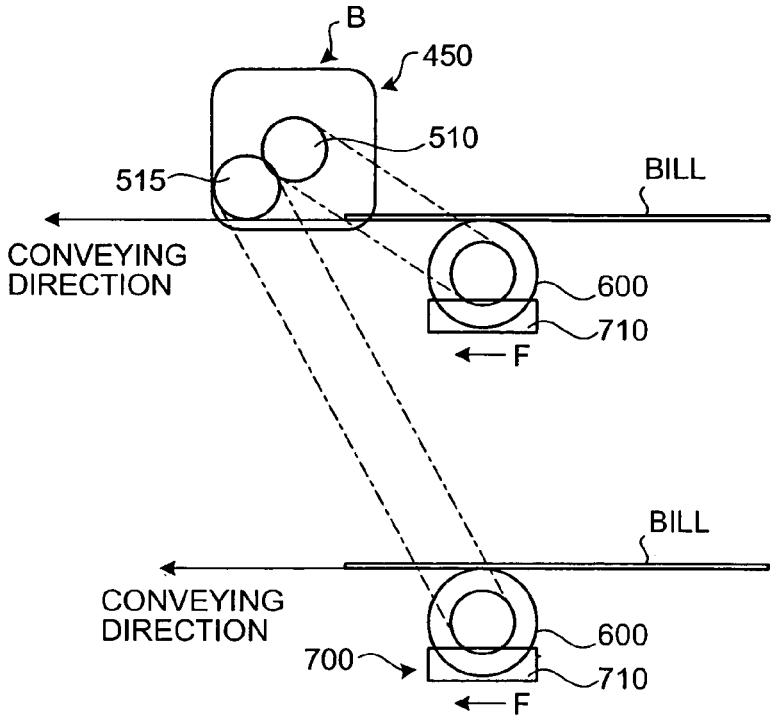
FIG. 4A is a schematic diagram of a bill feeding mechanism of the paper-sheet handling apparatus.
Figure 4B:
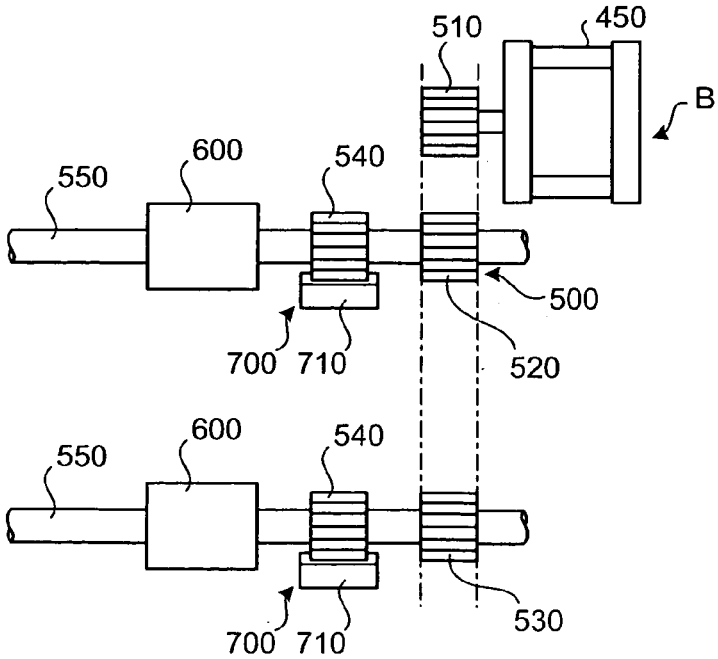
FIG. 4B is a schematic diagram of the bill feeding mechanism for explaining a structure of a drive system thereof.

The cassette 300 has a function of feeding out a bill stored in the cassette 300 to the feeding/conveying unit 230 one by one by a feeding mechanism B shown in FIGS. 4A and 4B. Furthermore, the cassette 300 includes a feeding control mechanism 500, a reverse-conveying control mechanism 700, a lock mechanism 800, and a cassette attaching/detaching mechanism 900.

Moreover, the cassette 300 includes the cassette attaching/detaching mechanism 900 that functions with respect to a main body the paper-sheet handling apparatus 100. The cassette attaching/detaching mechanism 900 includes the cassette attaching/detaching button 910 shown in FIG. 2. It is possible to install or remove the cassette 300 when the cassette attaching/detaching button 910 is pressed. When an attaching/detaching lever 920 (release lever) is released, the cassette 300 is pushed out of the main body of the paper-sheet handling apparatus 100 for a predetermined distance.

As shown in FIG. 6, a pin 280 is arranged inside the cassette storage unit 240 to project toward the direction (downward in FIG. 6) to which the cassette 300 is taken out. The pin 280 is formed in such a manner that when the cassette 300 is installed in the cassette storage unit 240, the pin 280 sticks into the cassette 300 through a through hole 330 that is formed in the cassette 300.

When the pin 280 sticks into the cassette 300, the pin 280 presses block members 710 and 810 against a collar 725 that is included in the reverse-conveying control mechanism 700 and a collar 825 that is included in the lock mechanism 800 respectively, resisting against elastic force of a pressure spring 720 and a pressure spring 820.

Furthermore, since this pin 280 presses the block member 710, an engagement lever 380 and a groove 115 are engaged with each other in a state in which the pressure spring 720 is pressed. Thus, when the attaching/detaching lever 380 is released by pressing the cassette attaching/detaching button 330, the cassette 300 is pushed out in the direction to which the cassette 300 is taken out by the elastic force of the pressure spring 720.

The paper-sheet handling apparatus 100 according to the embodiment includes the feeding control mechanism 500, the reverse-conveying control mechanism 700, the lock mechanism 800, and the cassette attaching/detaching mechanism 900. The feeding control mechanism 500 sequentially feeds out bills of various denominations from the cassettes 300 by a single drive source, which is the conveying drive motor 450. The reverse-conveying control mechanism 700 returns a bill sticking out from the cassette 300, as shown in FIG. 3, due to failure in separation of bills inside the cassette 300. The lock mechanism 800 prevents a bill from being unnecessarily taken out by rotation of the pickup roller 600 that is generated when the cassette 300 is taken out from the cassette storage unit 240. The cassette attaching/detaching mechanism 900 attaches/detaches the cassette 300.

The feeding control mechanism 500 includes a one-way clutch. This enables to selectively feed out various denominations of bills set in the cassettes 300 by only a single unit of the single feeding/conveying drive motor 450 unlike a conventional paper-sheet handling apparatus that requires a drive source for each of the cassette independently.

When the cassette 300 is taken out of the cassette storage unit 240, the reverse-conveying control mechanism 700 makes the pickup roller 600 rotate reversely to the direction to which a bill is fed out to return a bill sticking out from the bill feeding port 325 due to overlapped feeding or failure in separation of bills inside the cassette 300.

The reverse-conveying control mechanism 700 operates upon removing the cassette 300 from the cassette storage unit 240. In other words, security improves because no bill is accidentally taken out by rotation of the pickup roller 600, which occurs when the cassette 300 is removed from the cassette storage unit 240. Moreover, unnecessary feeding of a bill is realized by utilizing an operation of attaching/detaching the cassette 300.

The lock mechanism 800 prevents rotation of the pickup roller 600, which occurs when the cassette 300 is removed from the cassette storage unit 240. Therefore, it is possible to prevent a bill from being stolen with a simple structure.

The cassette attaching/detaching mechanism 900 pushes the cassette 300 out in the direction to which the cassette 300 is taken out by releasing the attaching/detaching lever 920. The attaching/detaching lever 920 is released when the cassette attaching/detaching button 910 shown in FIG. 2 is pressed. Thus, it is possible to easily take out the cassette 300 from the cassette storage unit 240 in the paper-sheet handling apparatus 100.

The paper-sheet handling apparatus 100 includes the feeding control mechanism 500 that selectively makes the feeding mechanisms in each of the cassettes 300, which stores bills of different denominations, by a single unit of the feeding/conveying drive motor 450 shown in FIG. 4A.

FIG. 4A is a schematic diagram of a bill feeding/conveying apparatus B. FIG. 4B is a schematic diagram of the bill feeding/conveying apparatus B for explaining a structure of a drive system. The cassettes 300 will be explained as the cassettes 300 that form a two-stage structure by arranging one of the cassettes 300 in an upper portion in the paper-sheet handling apparatus and the other one of the cassettes 300 in a lower portion in the paper-sheet handling apparatus.

As shown in FIGS. 4A and 4B, the feeding control mechanism 500 includes the pickup rollers 600 and the drive transmitting gear 520 and a drive transmitting gear 530. The pickup roller 600 feed out a bill from the cassettes 300 one by one. The drive transmitting gears 520 and 530 are fixed to the drive shafts 550 that transmit the driving of the feeding/conveying drive motor 450 to the pickup rollers 600. The feeding control mechanism 500 further includes a reverse-conveying control mechanism 700 and the block member 710.

The drive gear 510 fixed to the drive shaft of the feeding/conveying drive motor 540 and the drive transmitting gears 520 and 530 are engaged with each other in a drive transmittable manner. The drive transmitting gears 520 and 530 are exposed from a notch 326 formed in the cassette 300. The drive gear 510 is engaged with an intermediate gear 515 that transmits the driving to the cassette 300 that is arranged in a lower portion in a drive transmittable manner.

The drive transmitting gear 520 for the cassette 300 that is arranged at the upper portion includes a one-way clutch (unidirectional rotation clutch) that makes the drive transmitting gear 520 rotate when the feeding/conveying drive motor 450 is driven in forward rotation, and makes the drive transmitting gear 520 idle when the feeding/conveying drive motor 450 is driven in reverse rotation.

The drive transmitting gear 530 for the cassette 300 that is arranged at the lower portion includes a one-way clutch that makes the drive transmitting gear 530 idle when the feeding/conveying drive motor 450 is driven in the forward rotation, and makes the drive transmitting gear 530 rotate when the feeding/conveying drive motor 450 is driven in reverse rotation.

Figure 5A:
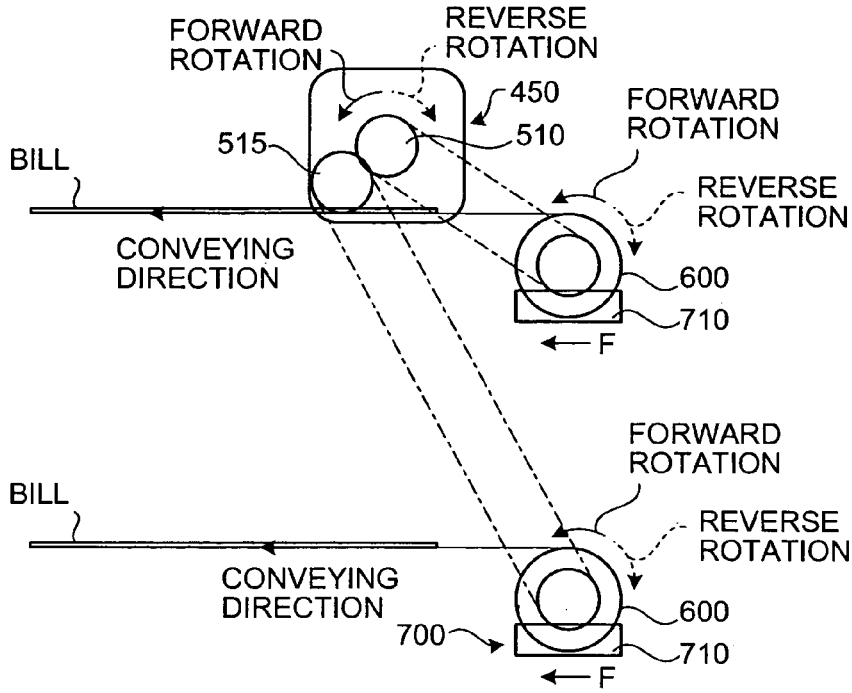
FIG. 5A is a schematic diagram of the bill feeding mechanism during an operation.
Figure 5B:
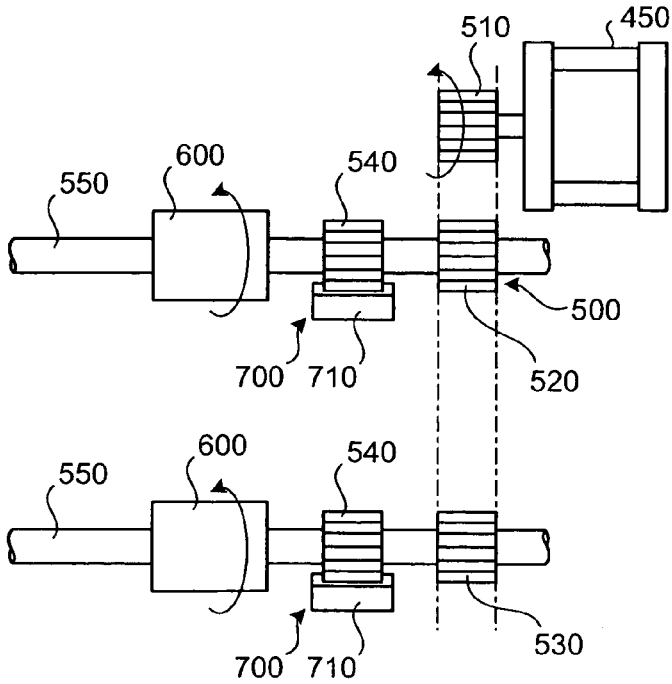
FIG. 5B is a schematic diagram of the bill feeding mechanism during the operation by the drive system.

As shown in FIGS. 5A and 5B, when a bill in the cassette 300 at the upper portion is to be fed out, the feeding/conveying drive motor 450 is driven in the forward rotation, which is in a counterclockwise direction. Specifically, the one-way clutch makes the drive transmitting gear 520 rotate when the feeding/conveying drive motor 450 is driven in the forward rotation. The drive transmitting gear 520 is rotated in a forward direction making forward rotation, and makes the pickup roller 600 attached to the drive shaft rotate in a direction to which the a bill is fed out. Thus, the bill in the upper cassette 300 is fed out.

On the other hand, the one-way clutch for the cassette 300 at the lower portion makes the drive transmitting gear 540 idle when the feeding/conveying drive motor 450 is driven in the forward rotation. Therefore, neither the drive transmitting gear 540 nor the pickup roller 600 rotates, consequently, the-bill in the cassette 300 at the lower portion is not fed out.

When the bill in the cassette 300 at the lower portion is to be fed out, the feeding/conveying drive motor 450 is driven in the reverse rotation, which is a clockwise direction. The one-way clutch makes the drive transmitting gear 530 rotate when the feeding/conveying drive motor 450 is driven in the reverse rotation. The drive transmitting gear 530 is rotated in the reverse rotation, and makes the pickup roller 600 attached to the drive shaft 550 rotate in the direction to which the bill is fed out. Thus, the bill in the cassette 300 at the lower portion is fed out.

On the other hand, the one-way clutch for the cassette 300 at the upper portion makes the drive transmitting gear 540 idle when the feeding/conveying drive motor 450 is driven in the reverse rotation. Therefore, neither the drive transmitting gear 540 nor the pickup roller 600 rotates, consequently, the bill in the cassette 300 at the upper portion is not fed out.

As explained above, according to the feeding control mechanism 500 in the embodiment, with the single unit of the conveying drive motor 45, various denominations of bills in the cassettes 300 can be selectively fed out.

While in the embodiment, the one-way clutches are arranged in the drive transmitting gears 520 and 530 that directly transmit the rotation drive force of the feeding/conveying drive motor 450 to the pickup rollers 600 respectively, a similar effect as in the embodiment can be obtained even if the one-way clutch may be arranged in the drive gear 510 fixed to the drive shaft of the feeding/conveying drive motor 454.

Figure 7:
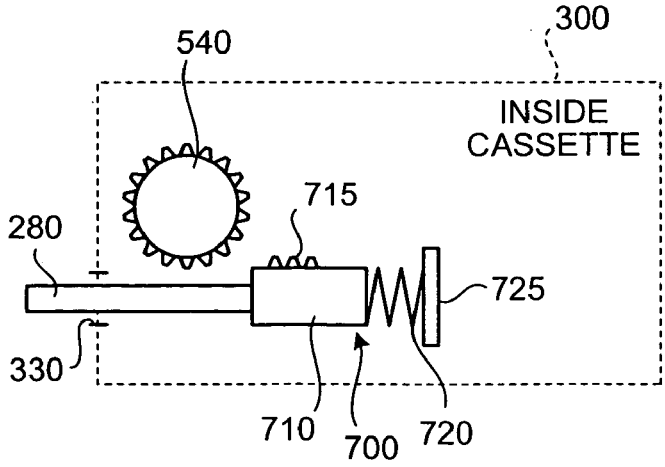
FIG. 7 is a schematic diagram of the feeding control mechanism.
Figure 8:
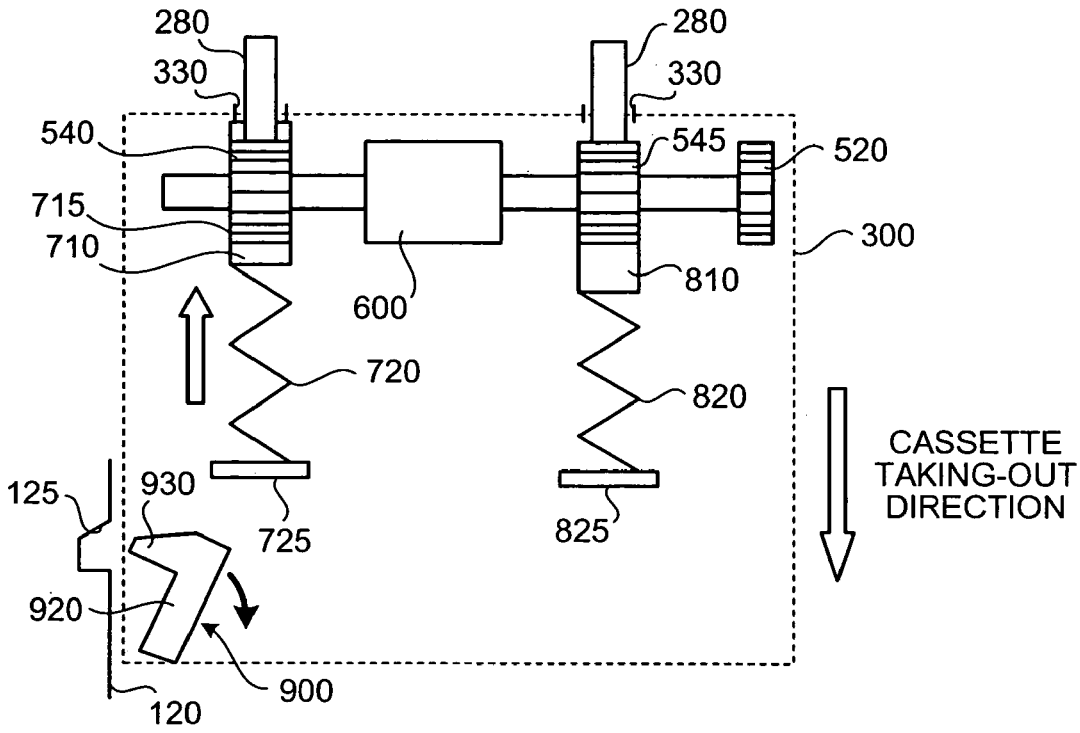
FIG. 8 is a schematic diagram for explaining an operation by the feeding control mechanism.
Figure 9:
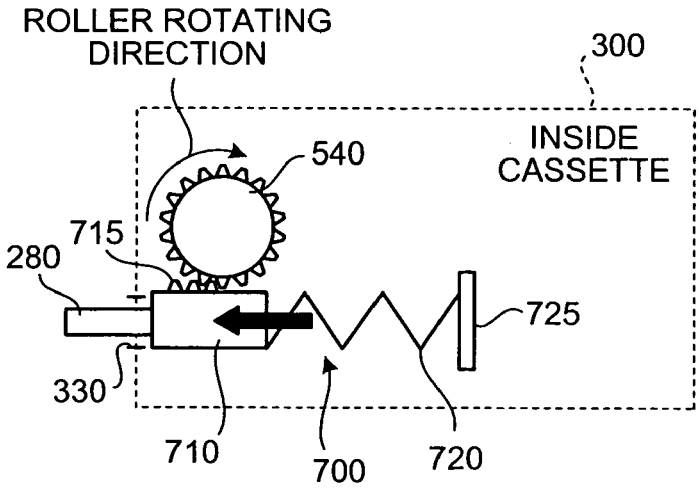
FIG. 9 is a side view for explaining the operation by the feeding control mechanism.

FIG. 6 is a schematic diagram for explaining a structure of the reverse-conveying control mechanism 700, and FIG. 7 is a side view thereof. FIG. 8 is a schematic diagram for explaining an operation of the reverse-conveying control mechanism 700, and FIG. 9 is a side view thereof. A state in which the cassette 300 is set in the cassette storage unit 340 is shown in FIGS. 6 and 7. A state in which the cassette 300 is taken out from the cassette storage unit 340 is shown in FIGS. 8 and 9.

As shown in FIGS. 6 and 7, the reverse-conveying control mechanism 700 includes a function of returning a bill sticking out from the bill feeding port 325 due to overlapped feeding or failure in separation of bills, when the cassette 300 is removed by operating the block member 710 by the elastic force of the pressure spring 720.

As shown in FIGS. 6 and 7, the reverse-conveying control mechanism 700 includes a function of returning a bill sticking out into the cassette 300 by rotating the pickup roller 600 in a direction reverse to the direction to which the bill is conveyed when the cassette 300 is taken out of the cassette storage unit 240. The reverse-conveying control mechanism 700 includes the drive gear 540 that is fixed to the drive shaft 550 that rotates the pickup roller 600, the block member 710 on which a spur gear 711 is formed, and the pressure spring 720 that presses this block member 710 toward the direction (upward in FIG. 6) to which the bill is conveyed. The pressure spring 720 is fit between an end of the block member 710 and the collar 725.

As shown in FIG. 6, the cassette attaching/detaching mechanism 900 includes the attaching/detaching lever 920 that is arranged at a lower portion in the cassette 300. A claw 930 is formed in the attaching/detaching lever 920. The cassette 300 is fixed in a predetermined position in the cassette storage unit 240 by engaging the claw 930 with an engagement groove 125 that is formed in a side face 120.

As shown in FIG. 6, since the block member 710 is pressed by the pin 280 resisting against the elastic force of the pressure spring 720 toward a rear side of the cassette 300, which is downward in FIG. 6, and rightward in FIG. 7, when the cassette 300 is set in the cassette storage unit 240. Therefore, the spur gear 715 in the block member 710 is not engaged with gear teeth of the drive gear 540. At this time, since a claw 981 of an attaching/detaching lever 980 that is formed with a plate-spring is engaged with the groove 115, the cassette 300 is fixed in the predetermined position in the cassette storage unit 240.

The size and the position of the block member 710 is set in such a manner that the drive gear 543 is not engaged with the spur gear 715 in the block member 710 in a state in which the drive gear 543 and the abutted with each other when the cassette 300 is set inside the cassette storage unit 240.

As shown in FIG. 8, the claw 930 in the attaching/detaching lever 920 is disengaged and separated from the engagement groove 125 when the cassette attaching/detaching button 910 is pressed.

The block member 710 moves toward the direction (upward in FIG. 8, leftward in FIG. 9) to which the bill is fed out by the elastic force of the pressure spring 720. Thereby, the drive gear 540 is engaged with the spur gear 715 of the block member 710, and the rotation of the drive 540 is transmitted to the pickup roller 600. Thus, the pickup roller 600 is also rotated in a clockwise direction along with the rotation of the drive gear 540. As a result, a bill sticking out from the bill feeding port 325 shown in FIG. 3B can be returned into the cassette 300.

In this example, the claw 930 of the attaching/detaching lever 920 is separated from the groove 125 when the attaching/detaching button is pressed. Thus, the block member 710 moves to make the drive gear 540 engage with the spur gear 715 of the block member 710 by the elastic force of the pressure spring 720. Thus, the bill is returned into the cassette 300. The elastic force of the pressure spring 720 is utilized also to facilitate removal of the cassette 300.

The engagement groove 125 is formed in the side face (one side) of the cassette storage unit 240 while in the cassette 300, the cassette attaching/detaching button 910 and the attaching/detaching lever 920 are arranged. When the cassette 300 is inserted into the cassette storage unit 240, the engagement groove 125 is engaged with the claw 930 of the attaching/detaching lever 920. Thus, the cassette 300 is fixed in the predetermined position in the cassette storage unit 240. Furthermore, the cassette 300 can easily be taken out from the cassette storage unit 240 by pressing the cassette attaching/detaching button 910. Specifically, when the cassette attaching/detaching button 910 is pressed, the claw 930 is disengaged from the engagement groove 125.

Figure 10:
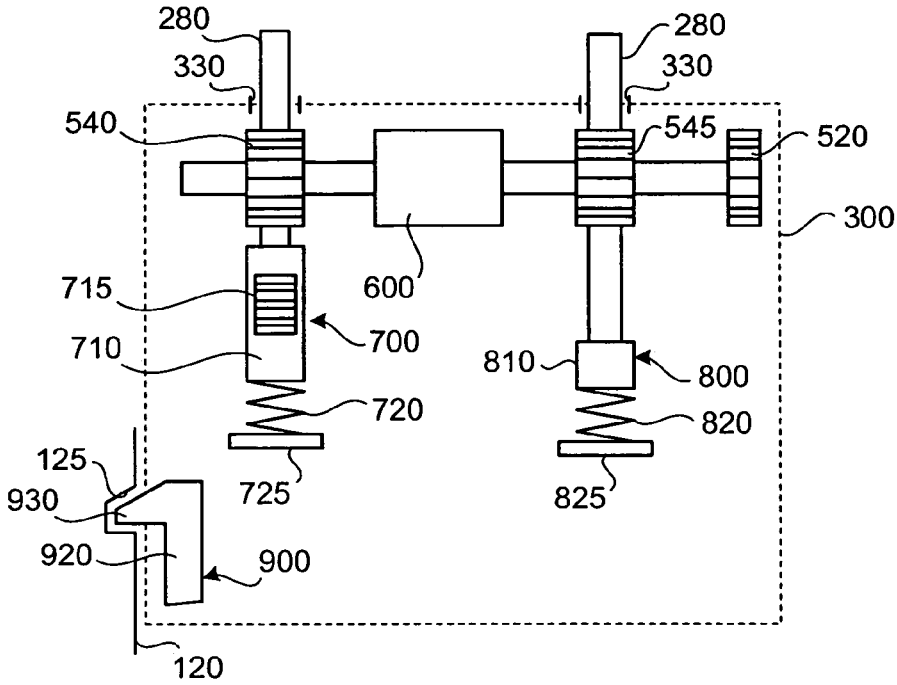
FIG. 10 is a schematic diagram for explaining a lock mechanism of the paper-sheet handling apparatus.
Figure 11:
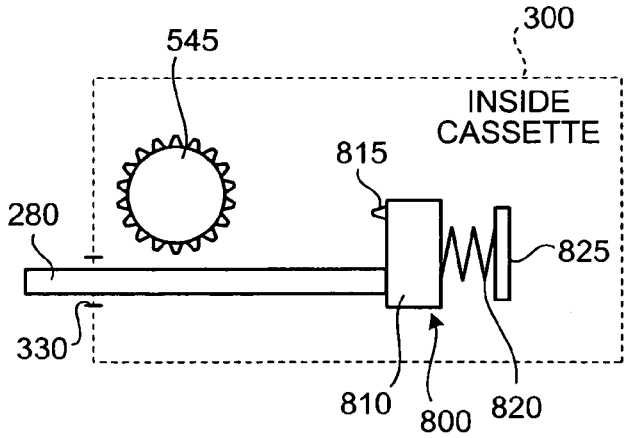
FIG. 11 is a side view for explaining the lock mechanism.
Figure 12:
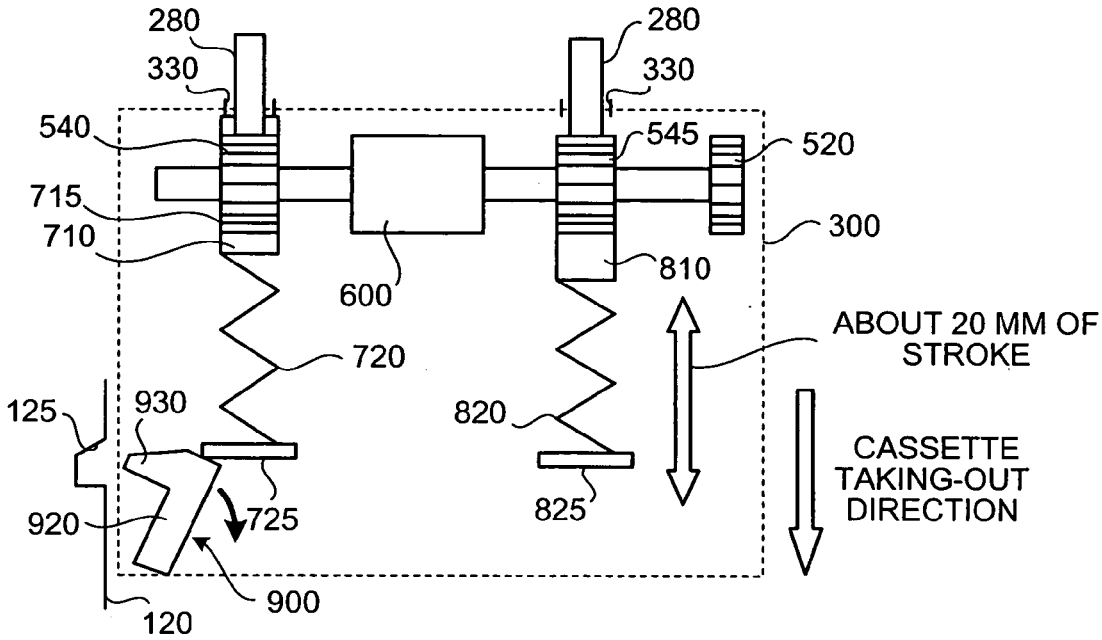
FIG. 12 is a schematic diagram for explaining an operation by the lock mechanism.
Figure 13:
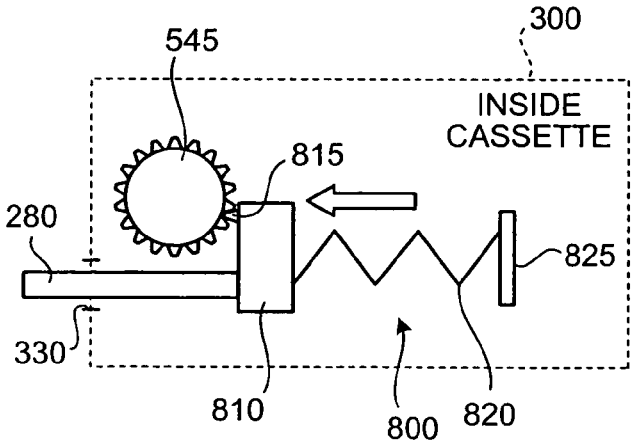
FIG. 13 is a side view for explaining the operation by the lock mechanism.
Figure 14A:
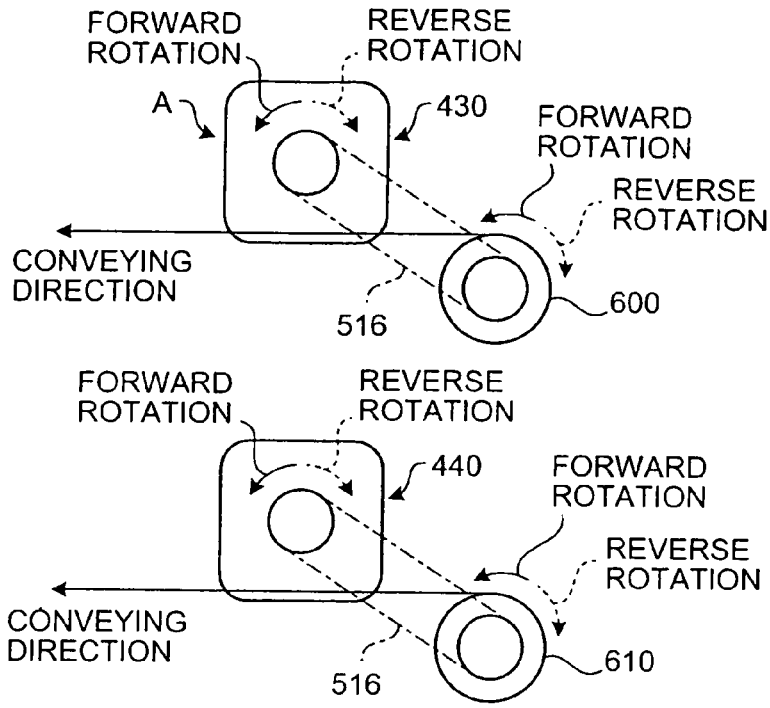
FIG.14A (RELATED ART)
FIG. 14A is a schematic diagram of a conventional bill feeding mechanism.
Figure 14B:
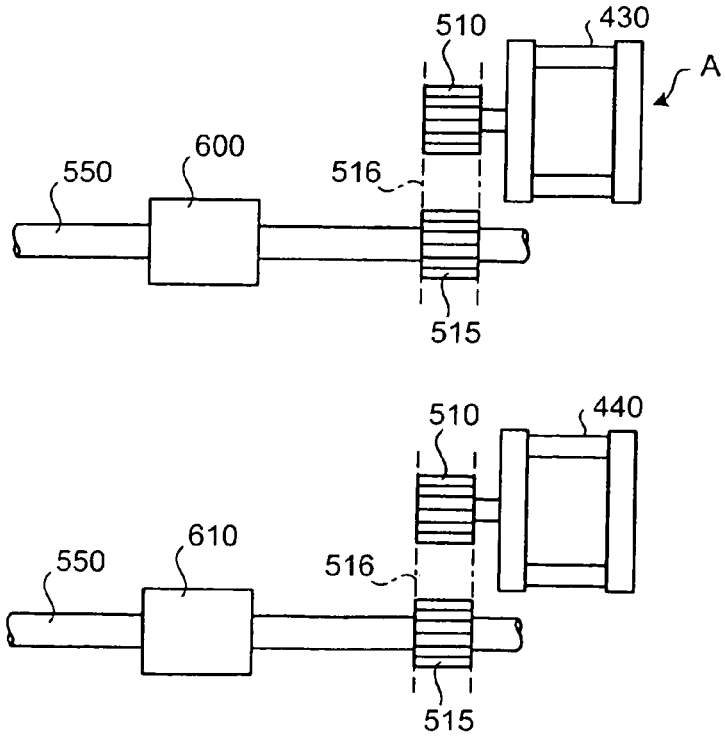
FIG.14B (RELATED ART)
FIG. 14B is a schematic diagram of a drive system of the conventional bill feeding mechanism.

FIG. 10 is a schematic diagram for explaining the lock mechanism 800, and FIG. 11 is a side view thereof. FIG. 12 is a schematic diagram for explaining an operation of the lock mechanism 800, and FIG. 13 is a side view thereof. A state in which the cassette 300 is set in the cassette storage unit 240 is shown in FIGS. 10 and 11. A state in which the cassette 300 is taken out from the cassette storage unit 240 is shown in FIGS. 12 and 13.

The lock mechanism 800 locks rotation of the drive gear 545 fixed to the drive shaft 550 thereby locking the rotation of the pickup roller 600 when the cassette 300 is removed from the cassette storage unit 240.

As shown in FIGS. 10 and 11, the lock mechanism 800 includes a block member 810 and a pressure spring 820. The pressure spring 820 is fit between a rear end of the block member 810 and the collar 825. The pressure spring 820 gives an elastic force with which the block member 810 is pressed toward the direction (upward in FIG. 10, leftward in FIG. 11) in which the bill is fed out.

As shown in FIG. 11, an engagement projection 815 is formed at a tip of the block member 810 in such a manner that the engagement projection 815 can engage with the gear teeth of the drive gear 545.

As shown in FIGS. 10 and 11, in the lock mechanism 800, the block member 810 is pressed in a direction away from the drive gear 545 resisting against the elastic force of the pressure spring 820 when the cassette 300 is set in the cassette storage unit 240. Thus, an engagement projection 620 of the block member 810 is not engaged with the drive gear 545 when the cassette 300 is in the cassette storage unit 240. Therefore, the pickup roller 600 rotates along with the rotation of the drive transmitting gear 520, and a bill can be freely fed out.

Since the claw 930 of the attaching/detaching lever 920 is disengaged from the engagement groove 125 as shown in FIGS. 12 and 13 when the cassette attaching/detaching button 910 is pressed to take out the cassette 300. Therefore, the block member 810 is pressed by an elastic force of the pressure spring 820 toward the direction to which the bill is fed out. An end of the block member 810 comes into contact with the drive gear 545, and the engagement projection 815 of the block member 810 is engaged with the gear teeth of the drive gear 545 as shown in FIG. 13.

Thus, the rotation of the drive gear 545 is prevented. In other words, even when the drive transmitting gear 520 is manually rotated in the state in which the cassette 300 is taken out from the paper-sheet handling apparatus 100 to take out a bill in the cassette 300, the drive transmitting gear 540 is locked by the lock mechanism 800. Moreover the rotation of the drive gear 520 is also prevented, therefore, the pickup roller 600 cannot be rotated. Thus, the bill is prevented from being fed out from the bill feeding port 325, thereby preventing the bill from being stolen, and improving security.

As explained above, the paper-sheet handling apparatus 100 according to the embodiment includes the feeding control mechanism 500 that selectively feeds out various denominations of bills from the cassettes 300 with only a single unit of the single drive source (conveying drive motor 450), the reverse-conveying control mechanism 700 that returns a bill sticking out from the cassette 300 due to failure in separation inside the cassette 300, the lock mechanism 800 that prevents the bill from being accidentally taken out due to rotation of the pickup roller 600, and the cassette attaching/detaching mechanism 900 that facilitates attaching/detaching the cassette 300. Therefore, improvement in operability and improvement in security can be achieved. In addition, cost reduction can be achieved by reducing a number of parts. Furthermore, the cassette 300 can be easily removed from the paper-sheet handling apparatus 100 by pressing the cassette attaching/detaching button 910 in the cassette attaching/detaching mechanism 900, and a bill reverse-conveying control is performed utilizing action in the removing/inserting operation of the cassette 300.

According to the present invention, improvement in operability and improvement in security can be achieved. Furthermore, it is possible to reduce manufacturing cost, and to accurately feed out and convey a bill in each cassette. It is also possible to realize a compact paper-sheet handling apparatus that includes a reduced number of parts.

Moreover, according to the present invention, it is possible to maintain security even when an electrical trouble occurs in the paper-sheet handling apparatus.

Furthermore, according to the present invention, it is possible to selectively feed out a bill in the cassette accurately without preparing more than one driving source.

Furthermore, according to the present invention, it is possible to prevent a bill stored in the cassette from being taken out when the cassette is taken out, thereby achieving improvement in security.

Moreover, according to the present invention, it is possible to easily and accurately attach and detach a cassette to and from the cassette storage unit.

Although the invention has been described with respect to a specific embodiment for a complete and clear disclosure, the appended claims are not to be thus limited but are to be construed as embodying all modifications and alternative constructions that may occur to one skilled in the art which fairly fall within the basic teaching herein set forth.

What is claimed is:

1. A paper-sheet handling apparatus comprising:

a cassette that stores a paper sheet;

a cassette compartment that stores a plurality of the cassettes;

a feeding mechanism that feeds out the paper sheet stored in the cassette;

a conveying mechanism that conveys the paper sheet fed out;

a sheet discharging port through which the paper sheet is discharged out;

a sheet discharging mechanism that discharges the paper sheet through the sheet discharging port;

a feeding control mechanism that controls feeding out of the paper sheet stored in the cassette, wherein the feeding control mechanism has a function of selectively feeding out the paper sheet from the cassette, and the function is realized by a single drive source; and a reverse-conveying mechanism including a spring urging a block member having a spur gear toward a drive transmitting gear, wherein the reverse-conveying mechanism returns the paper sheet to the cassette when the spur gear engages the drive transmitting gear.

2. The paper-sheet handling apparatus according to claim 1, wherein the feeding control mechanism includes a rotation controlling unit that controls rotation of the feeding mechanism based on a direction of rotation of the drive source, wherein the direction of the rotation of the drive source that allows the rotation controlling unit to make the feeding mechanism in one of the cassettes rotate is different from that of another one of the cassettes.

3. The paper-sheet handling apparatus according to claim 2, wherein the rotation controlling unit is a one-way clutch.

4. The paper-sheet handling apparatus according to claim 1, wherein the cassette includes a lock mechanism that prevents rotation driving by the feeding control mechanism that conveys paper sheet in the direction of feeding the paper sheet.

5. The paper-sheet handling apparatus according to claim 1, further comprising a cassette attaching/detaching mechanism for attaching and detaching the cassette to and from the cassette compartment, wherein the cassette attaching/detaching mechanism includes a cassette attaching/detaching unit that attaches and detaches the cassette; and an attaching/detaching lever that is engaged with a groove that is formed in the cassette compartment.

6. A paper-sheet handling apparatus comprising:

a cassette that stores a paper sheet;

a cassette compartment that stores a plurality of the cassettes;

a feeding mechanism that feeds out the paper sheet;

a conveying mechanism that conveys the paper sheet fed out;

a sheet discharging port through which the paper sheet is discharged out;

a sheet discharging mechanism that discharges the paper sheet through the sheet discharging port;

a feeding control mechanism that controls feeding out of the paper sheet;

a feeding driving unit that outputs a drive force by which the paper sheet is conveyed in a direction of feeding the paper sheet;

a first gear unit that makes the feeding control mechanism rotate by transmitting a drive force of the feeding driving unit;

a second gear unit that makes the feeding control mechanism rotate by transmitting the drive force of the feeding driving unit, wherein the first gear unit and the second gear unit include a rotation controlling unit that controls rotation of the feeding mechanism based on a direction of the rotation of the feeding driving unit, and the directions of the feeding driving unit that allow the rotation controlling units in the first gear unit and the second gear unit to make the feeding mechanism rotate are different from each other; and a reverse-conveying mechanism including a spring urging a block member having a spur gear toward a drive transmitting gear, wherein the reverse-conveying mechanism returns the paper sheet to the cassette when the spur gear engages the drive transmitting gear.

7. The paper-sheet handling apparatus according to claim 6, wherein the rotation controlling unit is a one-way clutch.

8. The paper-sheet handling apparatus according to claim 6, wherein the first gear unit and the second gear unit include a one-way clutch therein.

9. A paper-sheet handling apparatus comprising:

a cassette that stores a paper sheet;

a cassette compartment that stores a plurality of the cassettes;

a feeding mechanism that feeds out the paper sheet;

a conveying mechanism that conveys the paper sheet fed out;

a sheet discharging port through which the paper sheet is discharged out;

a sheet discharging mechanism that discharges the paper sheet through the sheet discharging port;

a feeding control mechanism that controls feeding out of the paper sheet;

a feeding driving unit that outputs a drive force by which the paper sheet is conveyed in a direction of feeding the paper sheet;

a first gear unit that makes the feeding control mechanism rotate by transmitting a drive force of the feeding driving unit; and a second gear unit that makes the feeding control mechanism rotate by transmitting the drive force of the feeding driving unit, wherein the first gear unit and the second gear unit include a rotation controlling unit that controls rotation of the feeding mechanism based on a direction of the rotation of the feeding driving unit, and the directions of the feeding driving unit that allow the rotation controlling units in the first gear unit and the second gear unit to make the feeding mechanism is different from each other, wherein the cassette includes a reverse-conveying mechanism that returns the paper sheet, which is fed out by the feeding control mechanism, to the cassette, wherein the reverse-conveying mechanism includes a reverse driving unit that rotates the feeding mechanism in a direction reverse to the direction of feeding the paper sheet, and a pressure spring that triggers the reverse driving unit to operate, the pressure spring having an elastic force, wherein the reverse driving unit includes a moving member that is moved by the elastic force of the pressure spring, a spur gear that is formed on the moving member, and a drive gear that is engaged with the spur gear, and when the spur gear and the drive gear are engaged with each other, the reverse driving unit makes the feeding mechanism rotate in the direction reverse to the direction of feeding the paper sheet.

10. A paper-sheet handling apparatus comprising:

a cassette that stores a paper sheet;

a cassette compartment that stores a plurality of the cassettes;

a feeding mechanism that feeds out the paper sheet;

a conveying mechanism that conveys the paper sheet fed out;

a sheet discharging port through which the paper sheet is discharged out;

a sheet discharging mechanism that discharges the paper sheet through the sheet discharging port;

a feeding control mechanism that controls feeding out of the paper sheet;

a feeding driving unit that outputs a drive force by which the paper sheet is conveyed in a direction of feeding the paper sheet;

a first gear unit that makes the feeding control mechanism rotate by transmitting a drive force of the feeding driving unit; and a second gear unit that makes the feeding control mechanism rotate by transmitting the drive force of the feeding driving unit, wherein the first gear unit and the second gear unit include a rotation controlling unit that controls rotation of the feeding mechanism based on a direction of the rotation of the feeding driving unit, and the directions of the feeding driving unit that allow the rotation controlling units in the first gear unit and the second gear unit to make the feeding mechanism is different from each other, wherein the cassette includes a reverse-conveying mechanism that returns the paper sheet, which is fed out by the feeding control mechanism, to the cassette, wherein the reverse-conveying mechanism activates a reverse conveying control when the cassette is being taken out.

11. The paper-sheet handling apparatus according to claim 6, wherein the cassette includes a lock mechanism that prevents rotation driving by the feeding mechanism that conveys paper sheet in the direction of feeding the paper sheet.

12. The paper-sheet handling apparatus according to claim 11, wherein the lock mechanism includes a rotation preventing unit that prevents rotation driving by the feeding mechanism.

13. The paper-sheet handling apparatus according to claim 12, wherein the lock mechanism further includes a pressure spring that presses the rotation preventing unit against the first gear unit and the second gear unit that transmits a driving force for the feeding mechanism, the driving force toward the direction of feeding the paper sheet, and the lock mechanism prevents rotation of the first gear unit and the second gear unit using the elastic force of the pressure spring.

14. The paper-sheet handling apparatus according to claim 6, further comprising a cassette attaching/detaching mechanism for attaching and detaching the cassette to and from the cassette compartment, wherein the cassette attaching/detaching mechanism includes a cassette attaching/detaching unit that attaches and detaches the cassette; and an attaching/detaching lever that is engaged with a groove that is formed in the cassette compartment.

* * * * *